US006435945B1

(12) United States Patent
Somekh

(10) Patent No.: US 6,435,945 B1
(45) Date of Patent: Aug. 20, 2002

(54) CHEMICAL MECHANICAL POLISHING WITH MULTIPLE POLISHING PADS

(75) Inventor: Sasson Somekh, Los Altos Hills, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 09/583,074

(22) Filed: Feb. 10, 1999

Related U.S. Application Data

(63) Continuation of application No. 09/066,271, filed on Apr. 24, 1998, now Pat. No. 5,897,426.

(51) Int. Cl.[7] ..... B24B 7/22
(52) U.S. Cl. ..... 451/41; 451/57
(58) Field of Search ..... 451/41, 36, 37, 451/57, 288, 287; 438/692, 693

(56) References Cited

U.S. PATENT DOCUMENTS

| | | | | |
|---|---|---|---|---|
| 3,841,031 A | | 10/1974 | Walsh | |
| 5,152,917 A | | 10/1992 | Pieper et al. | |
| 5,244,534 A | | 9/1993 | Yu et al. | |
| 5,342,419 A | | 8/1994 | Hibbard | |
| 5,378,251 A | | 1/1995 | Culler et al. | |
| 5,395,801 A | | 3/1995 | Doan et al. | |
| 5,514,245 A | | 5/1996 | Doan et al. | |
| 5,676,857 A | | 10/1997 | Landers et al. | |
| 5,718,618 A | | 2/1998 | Guckel et al. | |
| 5,738,574 A | | 4/1998 | Tolles et al. | |
| 5,752,875 A | * | 5/1998 | Ronay | 451/41 |
| 5,823,855 A | | 10/1998 | Robinson | |
| 5,876,268 A | * | 3/1999 | Lamphere et al. | 451/41 |
| 5,897,426 A | | 4/1999 | Somekh | |
| 5,972,792 A | * | 10/1999 | Hudson | 438/691 |
| 6,007,407 A | * | 12/1999 | Rutherford et al. | 451/41 |
| 6,099,389 A | * | 8/2000 | Nichols et al. | 451/36 |

FOREIGN PATENT DOCUMENTS

| | | |
|---|---|---|
| EP | 0 318 135 | 5/1989 |
| JP | 3-92264 | 4/1991 |

* cited by examiner

*Primary Examiner*—Robert A. Rose
(74) *Attorney, Agent, or Firm*—Fish & Richardson

(57) ABSTRACT

In chemical mechanical polishing, a substrate is planarized with one or more fixed-abrasive polishing pads. Then the substrate is polished with a standard polishing pad to remove scratch defects created by the fixed-abrasive polishing pads.

16 Claims, 4 Drawing Sheets

CHEMICAL MECHANICAL POLISHING WITH MULTIPLE POLISHING PADS

This is a continuation of U.S. application Ser. No. 09/066,271, filed Apr. 24, 1998 now U.S. Pat. No. 5,897, 426.

BACKGROUND

The present invention relates generally to chemical mechanical polishing of substrates, and more particularly to polishing with fixed-abrasive polishing pads.

Integrated circuits are typically formed on substrates, particularly silicon wafers, by the sequential deposition of conductive, semiconductive or insulative layers. After each layer is deposited, the layer is etched to create circuitry features. As a series of layers are sequentially deposited and etched, the outer or uppermost surface of the substrate, i.e., the exposed surface of the substrate, becomes increasingly non-planar. This non-planar outer surface presents a problem for the integrated circuit manufacturer. Therefore, there is a need to periodically planarize the substrate surface to provide a relatively flat surface. However, in some fabrication processes, planarization of the outer layer should not expose underlying layers.

Chemical mechanical polishing (CMP) is one accepted method of planarization. This planarization method typically requires that the substrate be mounted on a carrier or polishing head. The exposed surface of the substrate is placed against a rotating polishing pad. The polishing pad may be either a "standard" pad or a fixed-abrasive pad. A fixed-abrasive pad has abrasive particles held in a containment media, whereas a standard pad has a durable surface, without embedded abrasive particles. The carrier head provides a controllable load, i.e., pressure, on the substrate to push it against the polishing pad. A polishing slurry, including at least one chemically-reactive agent, and abrasive particles if a standard pad is used, is supplied to the surface of the polishing pad.

An effective CMP process not only provides a high polishing rate, but also provides a substrate surface which is finished (lacks small-scale roughness) and flat (lacks large-scale topography). The polishing rate, finish and flatness are determined by the pad and slurry combination, the relative speed between the substrate and pad, and the force pressing the substrate against the pad.

A reoccurring problem with fixed-abrasive pads is scratching of the substrate surface. Specifically, some CMP processes that use fixed-abrasive pads create shallow grooves, e.g., on the order of 500 angstroms deep, in the substrate surface. These grooves render the substrate finish unsuitable for integrated circuit fabrication, lowering the process yield.

SUMMARY

In one aspect, the invention is directed to a method of polishing a substrate. The process includes chemical mechanical polishing the substrate with a fixed-abrasive polishing pad until it is substantially planarized, and chemical mechanical polishing the substrate with a non-fixed-abrasive polishing pad to remove any scratches.

Implementations of the invention may include the following. The fixed-abrasive polishing pad may be located at a first polishing station of a polishing apparatus, and the non-fixed-abrasive polishing pad may be located at a second polishing station of the polishing apparatus. The substrate may be chemical mechanical polished with a second fixed-abrasive polishing pad or a second non-fixed-abrasive polishing pad at a third polishing station, e.g., before polishing the substrate at the second polishing station. A first polishing liquid may be supplied to the first polishing station, a second polishing liquid may be supplied to the second polishing station, and a third polishing liquid may be supplied to the third polishing station. The first polishing liquid may have a different pH than the second polishing liquid. The second polishing liquid may contain abrasive particles. The fixed-abrasive polishing pad may include an upper layer that includes abrasive grains held in a binder material, and a lower layer selected from the group consisting of polymeric film, paper, cloth, and metallic film. The non-fixed-abrasive polishing pad may include a first layer including polyurethane and a second layer including compressed felt fibers, or a layer composed of a poromeric material.

In another aspect, the invention is directed to a method of forming a planarized layer on a substrate. A layer is formed on a non-planar surface of the substrate. The layer is chemical mechanical polished with a fixed-abrasive polishing pad until a residual layer remains over the surface, and the residual layer is chemical mechanical polished with a non-fixed-abrasive polishing pad to remove any scratches. The residual layer has a thickness equal to or greater than the depth of any scratches therein.

Implementations of the invention may include the following. The residual layer may have a thickness approximately equal to the depth of any scratches, e.g., about 100 to 1000 angstroms. Polishing with the non-fixed-abrasive polishing pad may cease when a layer having a target thickness, e.g., 300 to 1000 angstroms, remains over the non-planar surface.

Advantages of the invention may include the following. Scratching of the substrate is reduced or eliminated, thereby increasing process yield.

Other features and advantages will be apparent from the following description, including the drawings and claims.

DETAILED DESCRIPTION

Figure 1:
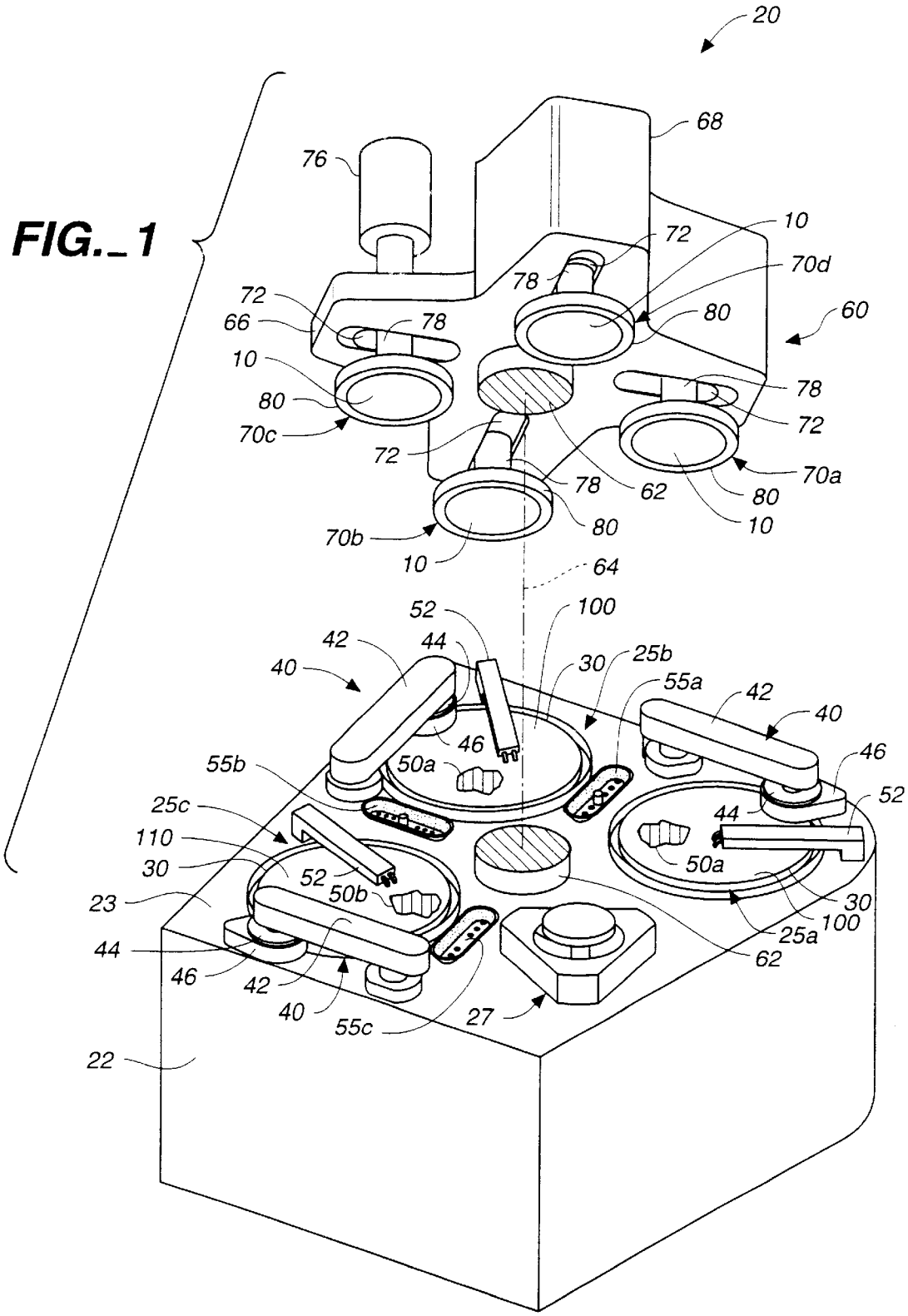
FIG. 1 is a schematic exploded perspective view of a chemical mechanical polishing apparatus.

Referring to FIG. 1, one or more substrates 10 will be polished by a chemical mechanical polishing apparatus 20. A description of polishing apparatus 20 may be found in U.S. Pat. No. 5,738,574, the entire disclosure of which is incorporated herein by reference. Polishing apparatus 20 includes a lower machine base 22 with a table top 23 mounted thereon and a removable outer cover (not shown). Table top 23 supports a series of polishing stations, including a first polishing station 25*a*, a second polishing station 25*b*, and a final polishing station 25*c*, and a transfer station 27. Transfer station 27 forms a generally square arrangement with the three polishing stations 25*a*, 25*b* and 25*c*. Transfer station 27 serves multiple functions, including receiving individual substrates 10 from a loading apparatus (not shown), washing the substrates, loading the substrates into carrier heads, receiving the substrates from the carrier heads, washing the substrates again, and finally, transferring the substrates back to the loading apparatus.

Each polishing station includes a rotatable platen 30 on which is placed a polishing pad. The first and second stations 25*a* and 25*b* may include a fixed-abrasive pad 100, whereas the final polishing station may include a standard pad 110. If substrate 10 is an "eight-inch" (200 millimeter) or "twelve-inch" (300 millimeter) diameter disk, then the platens and polishing pads will be about twenty inches or thirty inches in diameter, respectively. Each platen 30 may be a rotatable aluminum or stainless steel plate connected to a platen drive motor (not shown). For most polishing processes, the platen drive motor rotates platen 30 at thirty to two hundred revolutions per minute, although lower or higher rotational speeds may be used.

Polishing station 25*c* may include a pad conditioner apparatus 40. Pad conditioner apparatus 40 has a rotatable arm 42 holding an independently-rotating conditioner head 44 and an associated washing basin 46. The pad conditioner apparatus 40 maintains the condition of the polishing pad so that it will effectively polish substrates. Polishing stations 25*a* and 25*b* do not require a pad conditioner apparatus because fixed-abrasive pads generally do not require conditioning. However, as illustrated, each polishing station may include a conditioning station in the event that the CMP apparatus is used with other pad configurations.

Each polishing station also includes a combined slurry/rinse arm 52. At polishing stations 25*a* and 25*b*, a polishing liquid 50*a* containing deionized water and a chemically-reactive component (e.g., potassium hydroxide for oxide polishing) is supplied to the polishing pad surface by slurry/rinse arm 52. The polishing liquid 50*a* should not contain abrasive particles. At polishing station 25*c*, a polishing liquid 50*b* containing deionized water is supplied to the polishing pad surface by slurry/rinse arm 52. Polishing liquid 50*b* may also contain abrasive parties (e.g., silica particles for oxide polishing) and a chemically-reactive agent (e.g., potassium hydroxide for oxide polishing). The concentration of agents in the polishing liquids may be different. Specifically, the pH of polishing liquid 50*a* may differ from the pH of polishing liquid 50*b*.

Each slurry/rinse arm may include two or more slurry supply tubes to provide slurry to the surface of the polishing pad. Sufficient slurry may be provided to cover and wet the entire polishing pad. Each slurry/rinse arm 52 also includes several spray nozzles (not shown) which provide a high-pressure rinse of the polishing pad at the end of each polishing and conditioning cycle.

Two or more intermediate washing stations 55*a* and 55*b* may be positioned between neighboring polishing stations 25*a*, 25*b* and 25*c*. The washing stations rinse the substrates after they leave the polishing stations.

A rotatable multi-head carousel 60 is positioned above lower machine base 22. Carousel 60 is supported by a center post 62 and is rotated thereon about a carousel axis 64 by a carousel motor assembly located within machine base 22. Center post 62 supports a carousel support plate 66 and a cover 68. Carousel 60 includes four carrier head systems 70*a*, 70*b*, 70*c*, and 70*d*. Three of the carrier head systems receive and hold substrates, and polish them by pressing them against the polishing pads on the platens of polishing stations 25*a*–25*c*. One of the carrier head systems receives substrate from and delivers a substrate to transfer station 27.

The four carrier head systems 70*a*–70*d* are mounted on carousel support plate 66 at equal angular intervals about carousel axis 64. Center post 62 allows the carousel motor to rotate carousel support plate 66 and to orbit carrier head systems 70*a*–70*d* and the substrates attached thereto about carousel axis 64.

Each carrier head system 70*a*–70*d* includes a carrier or carrier head 80. A carrier drive shaft 74 connects a carrier head rotation motor 76 (shown by the removal of one quarter of cover 68) to carrier head 80 so that each carrier head 80 can independently rotate about its own axis. There is one carrier drive shaft and motor for each head. In addition, each carrier head 80 independently laterally oscillates in a radial slot 72 formed in carousel support plate 66. A slider (not shown) supports each drive shaft in its associated radial slot. A radial drive motor (not shown) may move the slider to laterally oscillate the carrier head.

The carrier head 80 performs several mechanical functions. Generally, the carrier head holds the substrate against the polishing pad, evenly distributes a downward pressure across the back surface of the substrate, transfers torque from the drive shaft to the substrate, and ensures that the substrate does not slip out from beneath the carrier head during polishing operations.

The carrier head 80 may include a flexible membrane (not shown) which provides a substrate receiving surface. A description of a suitable carrier head 80 may be found in U.S. patent application Ser. No. 08/745,679, entitled a CARRIER HEAD WITH a FLEXIBLE MEMBRANE FOR a CHEMICAL MECHANICAL POLISHING SYSTEM, filed Nov. 8, 1996, by Steven M. Zuniga et al., assigned to the assignee of the present invention, the entire disclosure of which is incorporated herein by reference.

Figure 2A:
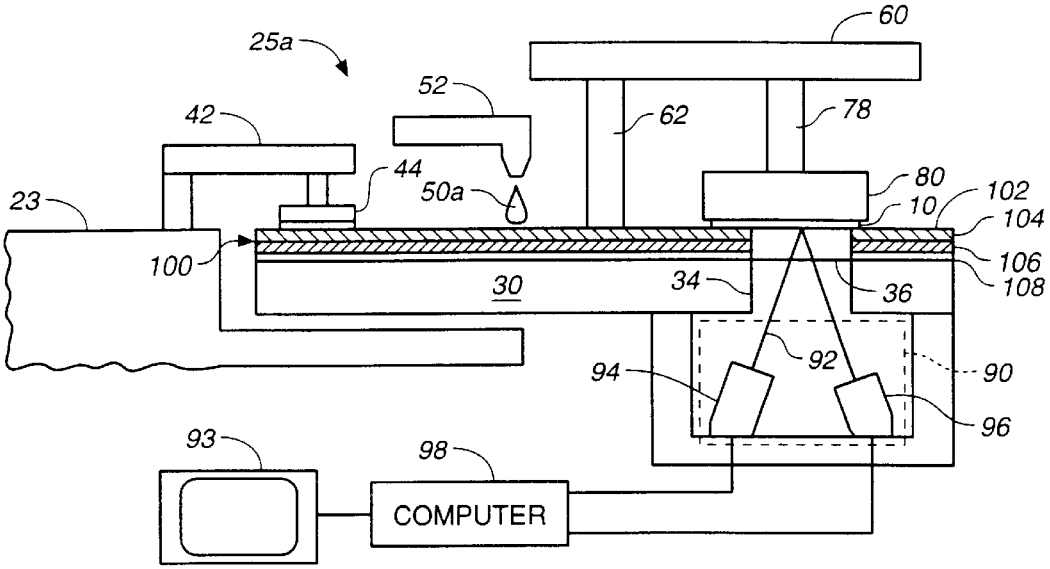
FIG. 2A is a schematic cross-sectional view of the first polishing station of the CMP apparatus of FIG. 1.

Referring to FIG. 2A, an aperture or hole 34 is formed in each platen 30 and a transparent window 36 is formed in a portion of the polishing pad overlying the hole. The transparent window 36 may be constructed as described in U.S. patent application Ser. No. 08/689,930, entitled METHOD OF FORMING a TRANSPARENT WINDOW IN A POLISHING PAD FOR A CHEMICAL MECHANICAL POLISHING APPARATUS by Manoocher Birang, et al., filed Aug. 26, 1996, and assigned to the assignee of the present invention, the entire disclosure of which is incorporated herein by reference. The hole 34 and transparent window 36 are positioned such that they have a "view" of substrate 10 during a portion of the platen's rotation, regardless of the translational position of the polishing head. A laser interferometer 90 is located below platen 30. The laser interferometer includes a laser 94 and a detector 96. The laser generates a collimated laser beam 92 which propagates through transparent window 36 to impinge upon the exposed surface of substrate 10.

Laser 94 is activated to generate laser beam 92 during a time when hole 34 is adjacent substrate 10. In operation, CMP apparatus 20 uses laser interferometer 90 to determine the amount of material removed from the surface of the substrate, or to determine when the surface has become planarized. A general purpose programmable digital computer 98 may be connected to laser 94 and detector 96. Computer 98 may be programmed to activate the laser when the substrate overlies the window, to store measurements from the detector, to display the measurements on an output device 93, and to detect the polishing endpoint, as described in aforementioned U.S. patent application Ser. No. 08/689,930.

Still referring to FIG. 2A, at first and second polishing stations 25*a* and 25*b*, the platen supports a fixed-abrasive polishing pad 100 having a polishing surface 102. The fixed-abrasive polishing pad 100 includes an upper layer 104 and a lower layer 106. Lower layer 106 may be attached to platen 30 by a pressure-sensitive adhesive layer 108. Upper layer 104 typically will be a 5–200 mil thick abrasive composite layer, composed of abrasive grains held or embedded in a binder material. The abrasive grains may have a particle size between about 0.1 and 1500 microns, and have a Mohs'hardness of at least 8. Examples of such grains include fused aluminum oxide, ceramic aluminum oxide, green silicon carbide, silicon carbide, chromia, alumina zirconia, diamond, iron oxide, ceria, cubic boron nitride, garnet and combinations thereof. The binder material may be derived from a precursor which includes an organic polymerizable resin which is cured form the binder material. Examples of such resins include phenolic resins, urea-formaldehyde resins, melamine formaldehyde resins, acrylated urethanes, acrylated epoxies, ethylenically unsaturated compounds, aminoplast derivatives having at least one pendant acrylate group, isocyanurate derivatives having at least one pendant acrylate group, vinyl ethers, epoxy resins, and combinations thereof. Lower layer 106 typically will be a 25–200 mil thick backing layer, composed of a material such as a polymeric film, paper, cloth, a metallic film or the like.

Fixed-abrasive polishing pads are described in detail in the following U.S. patents, all of which are incorporated by reference: U.S. Pat. No. 5,152,917, issued on Oct. 6,1992, and entitled STRUCTURED ABRASIVE ARTICLE; U.S. Pat. No. 5,342,419, issued on Aug. 30, 1994, and entitled ABRASIVE COMPOSITES HAVING A CONTROLLED RATE OF EROSION, ARTICLES INCORPORATING SAME, AND METHODS OF MAKING AND USING SAME; U.S. Pat. No. 5,368,619, issued on Nov. 29, 1994, and entitled REDUCED VISCOSITY SLURRIES, ABRASIVE ARTICLES MADE THEREFROM AND METHODS OF MAKING SAID ARTICLES; U.S. Pat. No. and 5,378, 251, issued on Jan. 3, 1995, and entitled ABRASIVE ARTICLES AND METHOD OF MAKING AND USING SAME. Fixed-abrasive pads are available from 3M Corporation of Minneapolis, Minn.

Figure 2B:
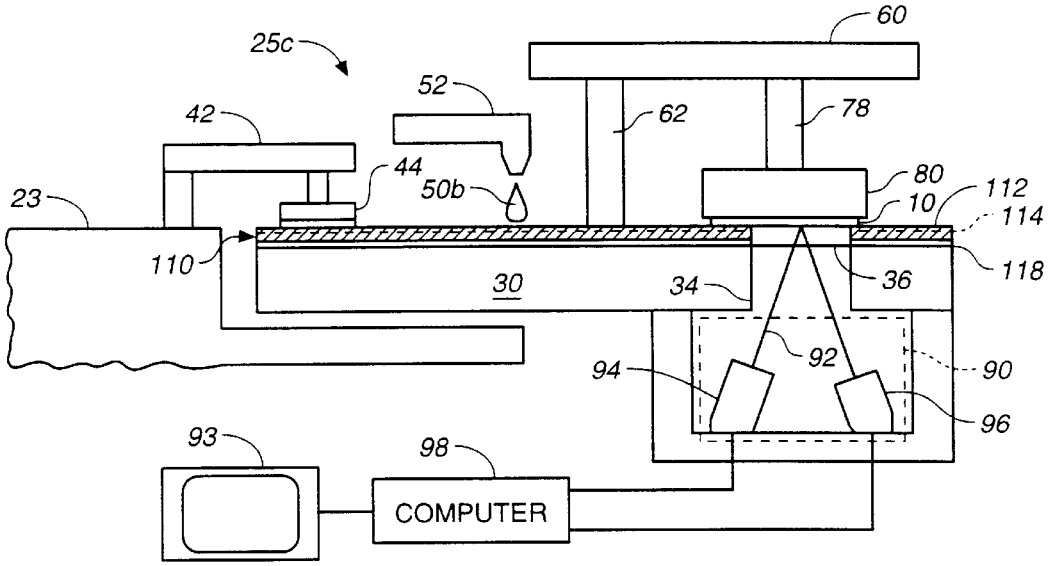
FIG. 2B is a schematic cross-sectional view of the final polishing station of the CMP apparatus of FIG. 1.

Referring to FIG. 2B, at final polishing station 25*c*, the platen may support a standard polishing or "non-fixed-abrasive" pad 110, i.e., a polishing pad that does not have embedded abrasive particles, having a generally smooth polishing surface 112 and including a single soft layer 114. Layer 114 may be attached to platen 30 by a pressure-sensitive adhesive layer 118. Layer 114 may be composed of a napped poromeric synthetic material. A suitable soft polishing pad is available from Rodel, Inc., of Newark, Delaware, under the trade name Politex. Polishing pad 110 may be embossed or stamped with a pattern to improve distribution of slurry across the face of the substrate. Alternatively, polishing pad 110 may be a standard two-layer pad in which the upper layer has a durable roughened surface and is harder than the lower layer. For example, the upper layer of the two-layer pad may be composed of microporous polyurethane or polyurethane mixed with a filler, whereas the lower layer maybe composed of compressed felt fibers leached with urethane. Both the upper and lower layers may be approximately fifty mils thick. A two-layer standard pad, with the upper layer composed of IC-1000 and the lower layer composed of SUBA-4, is available from Rodel (IC-1000 and SUBA-4 are product names of Rodel, Inc.). Polishing station 25*c* may otherwise be identical to polishing stations 25*a* and 25*b*.

Figure 3A:
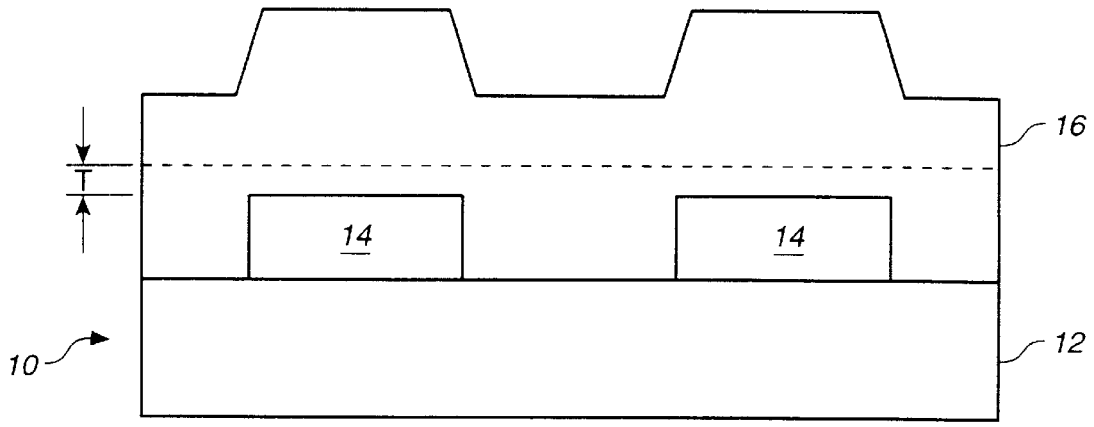
FIGS. 3A–3E are schematic cross sectional views of a substrate illustrating the method of the present invention.

FIGS. 3A–3E illustrate the process of chemical-mechanically polishing a layer, such as an insulative layer. Although an insulative layer is shown and discussed, the invention may also be applicable to polishing of metallic and semiconductive layers. As shown in FIG. 3A, substrate includes a metal layer 14, such as copper or tungsten, disposed on a silicon wafer 12. The metal layer 14 is either patterned or disposed on a patterned underlying layer so that it has a non-planar outer surface. An insulative layer 16, such as silicon dioxide, is disposed over metal layer 14. The outer surface of insulative layer 16 almost exactly replicates the underlying structures of metal layer 14, creating a series of peaks and valleys so that the exposed surface of the substrate is non-planar.

As discussed above, one purpose of planarization is to polish insulative layer 16 until its surface is flat and finished. Unfortunately, one problem with polishing with fixed-abrasive pads is the creation of scratches in the outer surface of the resulting substrate. Furthermore, as discussed above, the underlying metal layer should not be exposed. Thus, polishing should cease when an insulative layer having a target thickness T remains over the metal layer. The target thickness T may be about 300 to 1000 angstroms.

Figure 3B:
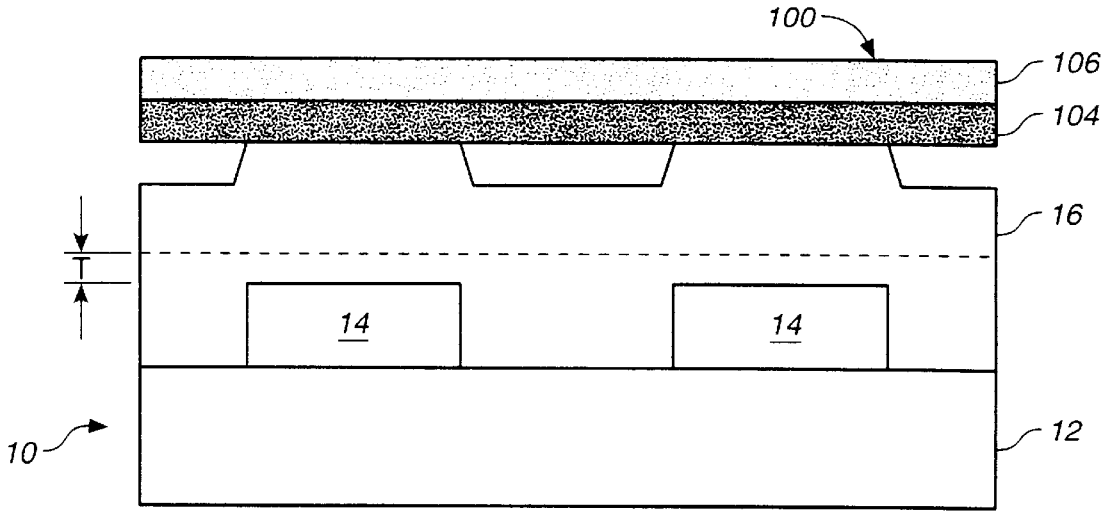
Figure 3C:
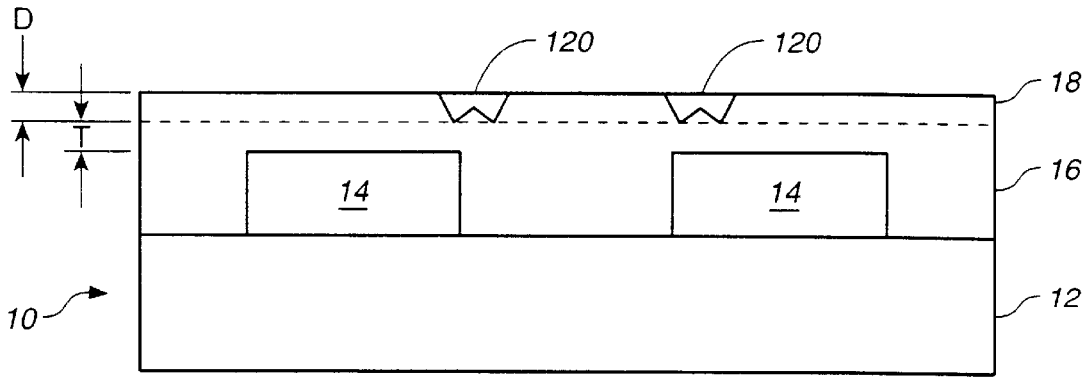

Referring to FIG. 3B, substrate 10 is initially polished at polishing stations 25*a* and 25*b* with polishing liquid 50*a* and one or more fixed-abrasive polishing pads 100. As shown in FIG. 3C, the substrate is polished until insulative layer 16 is substantially planarized, i.e., the large-scale topography such as the peaks and valleys have been substantially removed, and a residual film 18 having a thickness D remains over the target thickness. The thickness of the residual film is equal to or greater than the depth of the scratches 120. Specifically, the thickness D may be about 100 to 1000 angstroms, e.g., up to about 500 angstroms. The laser interferometer 90 (see FIG. 2A) may be used to determine when the substrate has been polished until a residual layer with the desired thickness remains.

Figure 3D:
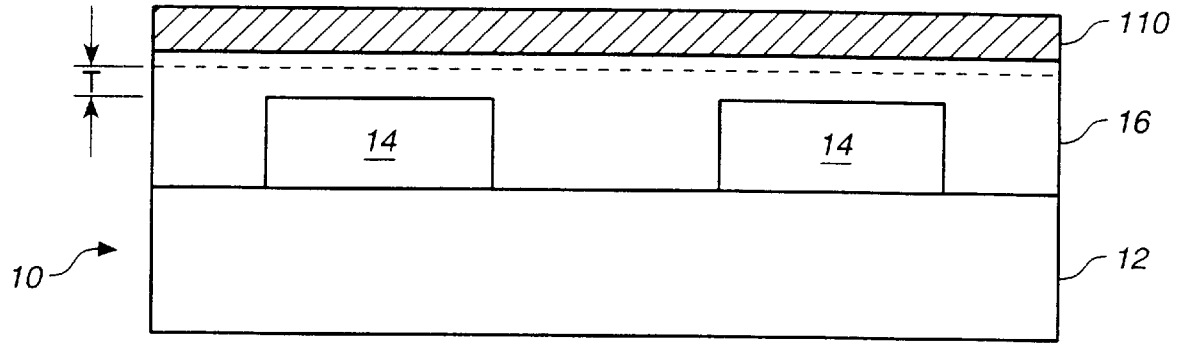
Figure 3E:
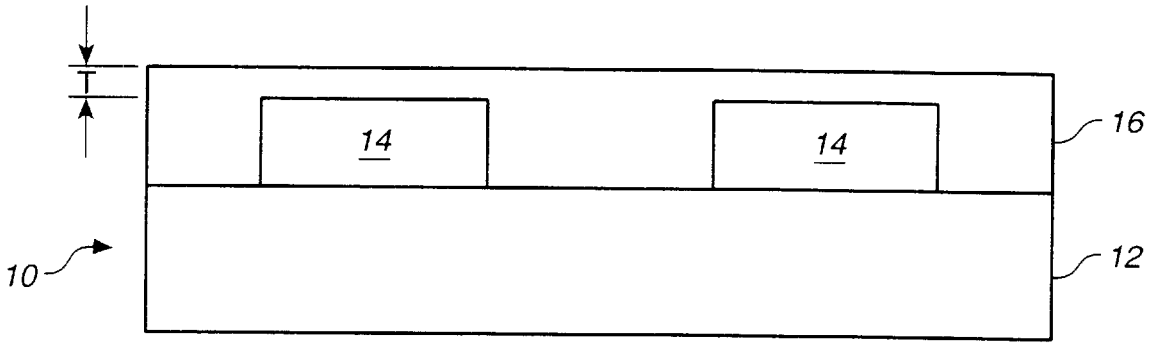

Then, referring to FIG. 3D, the substrate is polished at final polishing station 25*c* using polishing liquid 50*b* and standard polishing pad 110. The substrate is polished using the soft polishing pad until residual film 18 is removed and an insulative layer of the target thickness T remains over the metal layer, as shown in FIG. 3E. The scratches caused by polishing with the fixed-abrasive pads at polishing stations 25*a* and 25*b* are removed by polishing away the residual film with standard polishing pad 110. Thus, scratch defects are reduced and process yields increased. The majority of the insulative layer is planarized by use of the fixed-abrasive polishing pads, which do not require a slurry that contains abrasive particles or conditioning. Furthermore, in contrast to polishing methods in which only buffing is performed at the final station and the final station lies idle while polishing is performed at the first and second stations, the polishing liquid 50*b* may contain abrasive particles and a part of the insulative layer may be removed at the final polishing station, thus decreasing the polishing time at the first and second polishing stations and further increasing throughput. In addition, polishing with the soft pad helps remove polishing debris from the substrate surface.

Alternately, the substrate may be initially polished at polishing station 25*a* with polishing liquid 50*a* and a fixed-abrasive polishing pad 100, and then polished at polishing stations 25*b* and 25*c* with standard polishing pads 110. For example, particularly in metal polishing, copper layer may be polished with the fixed-abrasive pad at the first polishing station, the barrier layer may be polished with a standard polishing pad (e.g., a two-layer pad) at the second polishing station, and the scratches may be removed with another standard polishing pad (e.g., a soft pad) at the third polishing station. Different polishing liquids may be supplied to the three polishing stations.

The invention is not limited to the embodiment depicted and described. Rather, the scope of the invention is defined by the appended claims.

What is claimed is:

1. A method of polishing a substrate, comprising:

polishing a substrate that has a silicon wafer, a first non-planar layer disposed over the silicon wafer, and a second layer formed of a different material than the first layer and disposed on first layer with a first fixed-abrasive polishing pad and a non-abrasive liquid until a first portion of the second layer is removed;

polishing the substrate with a second fixed-abrasive polishing pad until a second portion of the second layer of the substrate is removed; and polishing the substrate with a non-fixed-abrasive polishing pad and an abrasive slurry to remove any scratches.

2. The method of claim 1, wherein the fixed-abrasive polishing pad is located at a first polishing station of a polishing apparatus and the non-fixed-abrasive polishing pad is located at a second polishing station of the polishing apparatus.

3. The method of claim 2, further comprising polishing the substrate with a second fixed-abrasive polishing pad and a second non-abrasive liquid at a third polishing station before polishing the substrate at the second polishing station.

4. The method of claim 2, further comprising polishing the substrate with a second non-fixed-abrasive polishing pad and a second abrasive slurry at a third polishing station.

5. A method of forming a planarized layer on a substrate, comprising:

forming a layer on a non-planar surface of the substrate;

polishing the layer with a fixed-abrasive polishing pad and a non-abrasive liquid until a residual layer remains over the surface, the residual layer having a thickness equal to or greater than the depth of any scratches therein; and polishing the residual-layer with a non-fixed-abrasive polishing pad and an abrasive slurry to remove any scratches.

6. The method of claim 5, wherein the residual layer has a thickness approximately equal to the depth of any scratches.

7. The method of claim 1, wherein the non-abrasive liquid has a different pH than the abrasive slurry.

8. The method of claim 1, wherein the abrasive slurry contains abrasive particles.

9. The method of claim 1, wherein the fixed-abrasive polishing pad includes an upper layer and a lower layer.

10. The method of claim 9, wherein the upper layer of the fixed-abrasive polishing pad includes abrasive grains held in a binder material.

11. The method of claim 9, wherein the lower layer of the fixed-abrasive polishing pad is selected from the group consisting of polymeric film, paper, cloth, and metallic film.

12. The method of claim 1, wherein the non-fixed-abrasive polishing pad includes a first layer including polyurethane and a second layer including compressed felt fibers.

13. The method of claim 1, wherein the non-fixed-abrasive polishing pad includes a layer composed of a poromeric material.

14. The method of claim 5, wherein the residual layer has a thickness of about 100 to 1000 angstroms.

15. The method of claim 5, wherein polishing with the non-fixed-abrasive polishing pad ceases when a layer having a target thickness remains over the nor-planar surface.

16. The method of claim 15, wherein the target thickness is about 300 to 1000 angstroms.

* * * * *

UNITED STATES PATENT AND TRADEMARK OFFICE

CERTIFICATE OF CORRECTION

PATENT NO. : 6,435,945 B1
DATED : August 20, 2002
INVENTOR(S) : Sasson Somekh

It is certified that error appears in the above-identified patent and that said Letters Patent is hereby corrected as shown below:

Column 7,
Line 17, before “fixed-abrasive” insert -- first --.
Line 18, before “second” replace “the” with -- a --.
Line 27, before “second” replace “the” with -- a --.

Column 8,
Lines 12, 15 and 18, before “fixed-abrasive” insert -- first --.

Signed and Sealed this

Nineteenth Day of November, 2002

*Attest:*

*Attesting Officer*

JAMES E. ROGAN
*Director of the United States Patent and Trademark Office*